US005779557A

United States Patent [19]

Scannell et al.

[11] Patent Number: 5,779,557

[45] Date of Patent: Jul. 14, 1998

[54] GOLFER'S FOOT BALANCE TRAINING AID

[76] Inventors: Lawrence M. Scannell, 92 Lowell Rd., Westford, Mass. 01886; Glenn L. Spacht, 3 Broad Path, Lloyd Neck, N.Y. 11743; Robert L. Benoit, 49 Chatham Dr., Oakdale, N.Y. 11769; William Fahey, 21 Sharon Ct., Kings Park, N.Y. 11754; Bernard I. Rachowitz, 28 Lloyd La., Lloyd Neck, N.Y. 11743

[21] Appl. No.: 814,103

[22] Filed: Mar. 10, 1997

Related U.S. Application Data

[60] Provisional application No. 60/013,224, Mar. 11, 1996.

[51] Int. Cl.[6] ..... A63B 69/36

[52] U.S. Cl. ..... 473/269; 473/409; 473/272

[58] Field of Search ..... 473/218, 269, 473/409, 270, 272; 273/187 R

[56] References Cited

U.S. PATENT DOCUMENTS

| | | | |
|---|---|---|---|
| 3,169,022 | 2/1965 | Kretsinger | 473/269 X |
| 4,037,847 | 7/1977 | Lorang | 473/269 |

*Primary Examiner*—George J. Marlo
*Attorney, Agent, or Firm*—Vernon C. Maine

[57] ABSTRACT

A method and apparatus for golfers, a training aid for detecting and indicating an out of balance condition of stance during practice swings. The device senses weight at the outer edge of the aft shoe of the user, calibrates or sets the weight sensed in a balanced stance condition as a null value or zero value, and signals the user when the weight then exceeds the null value.

14 Claims, 4 Drawing Sheets

GOLFER'S FOOT BALANCE TRAINING AID

This application claims priority of and is a continuation-in-part to U.S. provisional application Ser. No. 60/013,224, filed on Mar. 11, 1996, by one of the present inventors.

BACKGROUND OF THE INVENTION

1. Technical Field of the Invention

This invention most generally relates to training aids and devices for indicating an out-of-balance foot stance for golfers. More particularly, the invention relates to means to detect and announce a weight shift during a golfer's swing.

2. Background Art

A golfer, when addressing a ball for a shot, assumes a stance approximately parallel with the intended line of flight of the ball, with the feet about shoulder width apart. The left or lead foot (for right handed golfers) may be advanced somewhat for a "closed" stance, or drawn back somewhat for an "open" stance, and may be turned outward somewhat, depending on the golfer's style and the particulars of the instant shot. The back or aft foot is generally square as to the line of flight. Refer generally to FIG. 1.

The cycle of a full swing is a continuous, coordinated motion of the entire body and the club, that includes a coiling of the hips and a backswing to raise the club up over the right shoulder, reversing into an uncoiling of the hips and a downswing or power stroke that brings the clubhead into forceful contact with the ball.

Power from the hips is transmitted most efficiently, with maximum balance and accuracy, when the hips are rotated or coiled into a windup position and similarly unleashed with power and authority, if the golfer maintains a balanced stance without excessive lateral motion or swaying of the hips and body center out over the back foot and back again during the swing. FIG. 2 illustrates a windup in a balanced stance. FIG. 3 illustrates a windup shifting out of balance onto the aft foot.

The over-the-shoulder motion of the backswing is still in motion, radiating out through arms and hands and the club itself, when the golfer initiates the downswing or unwinding power stroke that will bring the club head into contact with the ball.

The power stroke is a coordinated explosive uncoiling of the hips with a crack-the-whip downstroke of arms, hands and club. The body center position is maintained and the hips are rotating through the line of flight with maximum power just as the clubhead catches up with the arms, hands and shaft to contact the ball. Ideally, the clubhead strikes the ball at the point in the stroke of maximum speed, energy transfer, and focus.

Excessive lateral motion or swaying of the hips out over the back foot, during the backswing, places the body center into an out-of-balance condition and inhibits the natural coiling of the hips. This results in an opposite motion of body center or hip sway during the power stroke, to regain balance. This reduces the power and accuracy of the swing. In other words, maximum hip rotation in the backswing equates to maximum power and accuracy in the power stroke, while shifting during the windup into an unbalanced stance over the aft foot reduces power and accuracy.

It may be readily observed that just prior to the windup or backswing, the feet are level on the ground with the golfer's weight about equally distributed between them. There is a balance of weight distribution across the width of the back foot as a result of the initial stance that is properly biased towards the instep side of the foot in order to keep the body centered during the swing.

If golfer's weight on the back foot is maintained on the instep side of the back foot throughout the backswing, the hips are coiled naturally, without lateral movement of the body center. This allows the golfer to then explosively uncoil the power of the legs and rotating hips, while maintaining a balanced position over the ball. This translates to more power and accuracy in the swing.

If the golfer's weight is shifted over the balance point to the outside edge of the back foot during the backswing, this indicates a lateral weight shift or swaying of the hips and body center towards the back foot, resulting in the hips being less than fully coiled and the body somewhat off balance. The hips must then be swayed forward again during the downstroke, arriving early without the full power potential of rotating hips, with the hands lagging behind, thus causing a slice.

The problem addressed herein has to do with this improper lateral motion or shifting of body center during the backswing, which results in less than full coiling of the hips and a corresponding reduction in the power and accuracy of the stroke. Put another way, it would be desirable and advantageous to sense and signal the shifting of the weight on the back foot past the inside and over to the outside edge of the foot during the backswing, allowing the golfer to identify the occurrence of lateral motion or out-of-balance condition during the swing.

SUMMARY OF THE INVENTION

The invention in it's simplest form is a training aid that alerts or indicates users such as golfers when the distribution or balance of weight between the feet, during a golf swing or other activity where maintaining a balanced stance is desirable, shifts out-of-balance towards one foot, or more particularly towards the outer edge of that foot.

It is an object of the invention to provide a device with means for sensing the weight at the outer edge of a shoe of the user, means for calibrating the sensor to a zero or null value for the weight and condition of a balanced stance, and means to indicate or signal to the user when the weight exceeds the balanced stance weight or null value.

A further object of the invention is to provide a training aid with top plate adapted to accept placement of a shoe against a reference edge, where the top plate is interconnected with a base plate and a spring or other element that will provide a graduated resistance to the displacement of the reference region of the top plate under increasing weight towards the base plate, and which incorporates means to detect the relative displacement of the reference region of the top plate towards the base plate.

A yet further objective is to provide an integral power source and signal capability so that a condition of unbalanced stance, excess weight over the calibrated or balanced stance weight, can be transmitted or otherwise indicated to the user.

Still other objects and advantages of the present invention will become readily apparent to those skilled in this art from the following detailed description, wherein I have shown and described only a preferred embodiment of the invention, simply by way of illustration of the best mode contemplated by me on carrying out my invention.

DESCRIPTION OF THE PREFERRED EMBODIMENT

Figure 2:
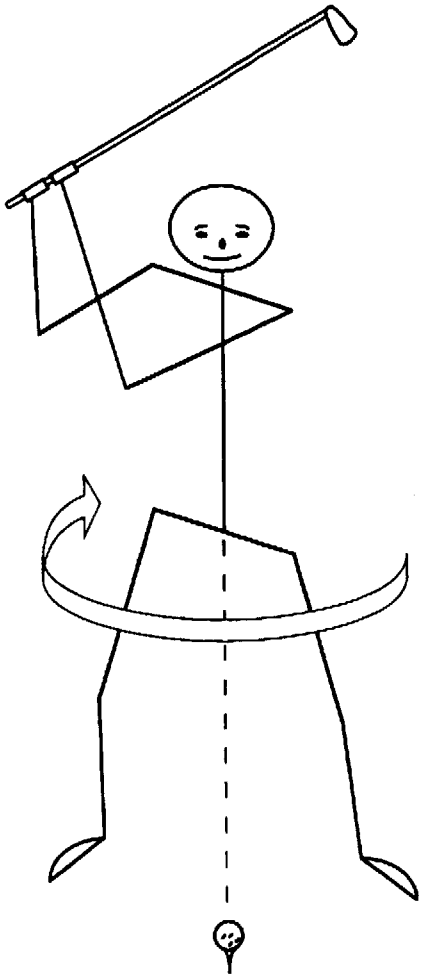
FIG. 2 is a front view of the golfer of FIG. 1, having maintained the body center position and properly coiled the hips during the backswing.
Figure 1:
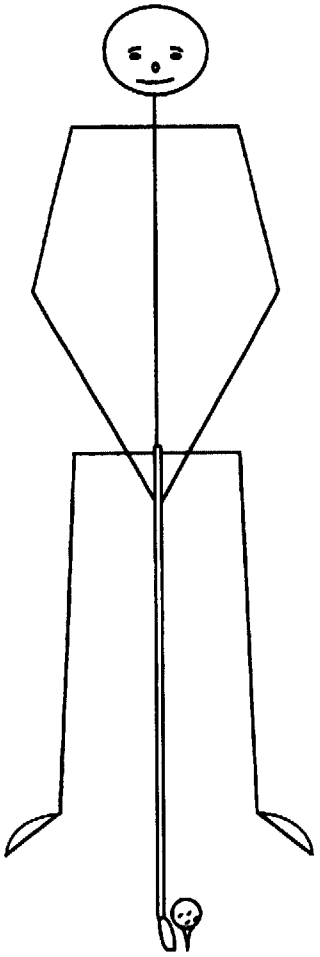
FIG. 1 is a front view of a golfer addressing the ball in a balanced stance, with body weight about evenly distributed on both feet.
Figure 3:
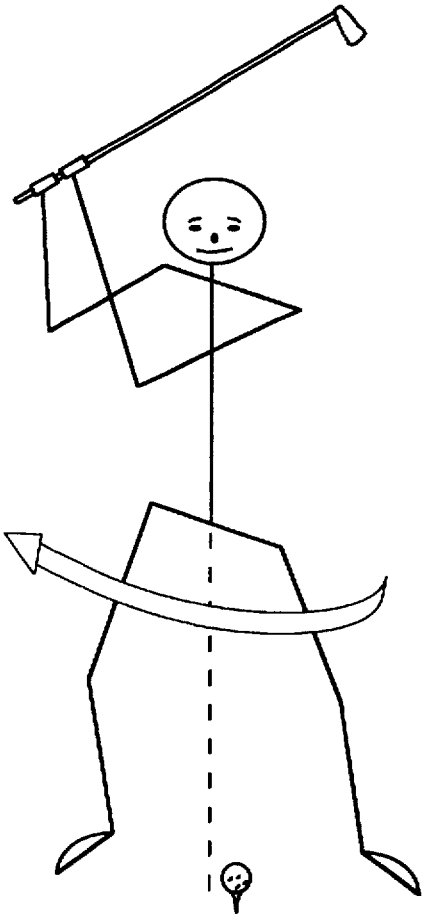
FIG. 3 is a front view of golfer of FIG. 1, having swayed the hips and shifted the body center onto the back foot, and failing to achieve a full coiling of the hips, during a backswing.

As will be realized, the invention is capable of other and different embodiments, and its several details are capable of modifications in various obvious respects, all without departing from the invention.

As an example, it may be a training aid for golfers or for others who's activities require a balanced stance that may be affected by improper weight shifting. The training aid would have a way to sense the amount of weight being placed on the outer edge of the user's shoe, and a means for calibrating the sensed weight to be a null value, or zero, when the user is standing in a balanced stance. The training aid would be equipped with a means for indicating or signaling the user when the weight on the outer edge of the shoe exceeded the balanced stance weight or null value.

As another example, the device may have a top plate with a reference edge, configured to accommodate the placement of a user's shoe up against the reference edge. The top plate may be oriented over a base plate in a non-rigid relationship, with an elastic element such as a spring or a foam pad attached to both plates to resist the application of weight in the region of the reference edge of the top plate. The base plate may incorporate a fulcrum upon which the top plate may bear and rotate, the fulcrum being positioned near the lateral center of the shoe position on the top plate, but biased towards the instep so that a weight to this foot or to the outer edge of this foot will result in increased weight in the region of the reference edge and resulting compression of the foam pad. The device would include means for detecting a change in the spatial relationship between the top plate and the base plate caused by the application of weight at the outer edge of a shoe on the top plate, such as would load a spring or compression a foam pad.

As yet another example, the training aid may have a proximity switch and an actuator connected to respective top and base plates and configured to work in combination so that changes in the relative position of the two plates causes the actuator to operate the switch. The actuator may be a tongue member extending laterally out or away from the fulcrum to where it would engage or disengage with the switch plunger with changing weight on the top plate causing variations in the degree of compression of the foam pad or load on a spring element.

As still yet another example, the proximity switch may be vertically adjustable by means of having threaded barrel and an adjustment wheel to adjust the vertical height of the switch relative to the base plate, or other means for affecting the relative distance between the actuator or tongue member and the plunger of the proximity switch so that under the weight of a balanced stance, the switch is just short of being operated, and any further increase in weight in the region of the reference edge or shoulder on the top plate will cause the switch to be operated. Also, the sensitivity of the device may be adjustable by lateral adjustment of the switch or varying the length or stiffness of the tongue member or other characteristics of the actuator.

As a further example, the training aid may have an electrical power source such as a battery in a battery box attached to the base plate, and an audible signal generator such as an electric buzzer or tone generator in a circuit controlled by the proximity switch, so that the signal is activated by the switch upon an overweight condition, indicating an out-of-balance condition of stance to the user.

Alternatively, the training aid might have an analog sensor and indicator, such as a pressure sensor and variable pitch tone generator where the pitch various with the amount of weight sensed. This embodiment may have means for calibrating or zeroing the indicator for the null value of a balanced stance condition.

As a yet further example, the method of the invention may be described as the sensing of the weight bearing on the outer edge of a shoe of the user, the calibrating of the weight under conditions of a balanced stance to be a null value or zero value, and indicating to the use whenever a condition of greater weight than the balanced or null value weight is being applied.

As a still yet further example, any such training aid may be equipped with additional capability to record and/or transmit the indicator output to a recorder, remoted audio output device or other receiver.

As an additional example, a sensor array between the top plate and the base plate may be pattern sensitive such that weight shifting or biasing towards the toe or heel of the foot, of any overlimit outboard pressure or motion may be sensed and indicated as such.

As a yet additional example, the weight sensor or sensor array of the training aid may be made sufficiently compact to be inserted inside a user's shoe, with the electronics remoted to an ankle band or attached at some other point to the shoe or the golfer's body.

Figure 4:
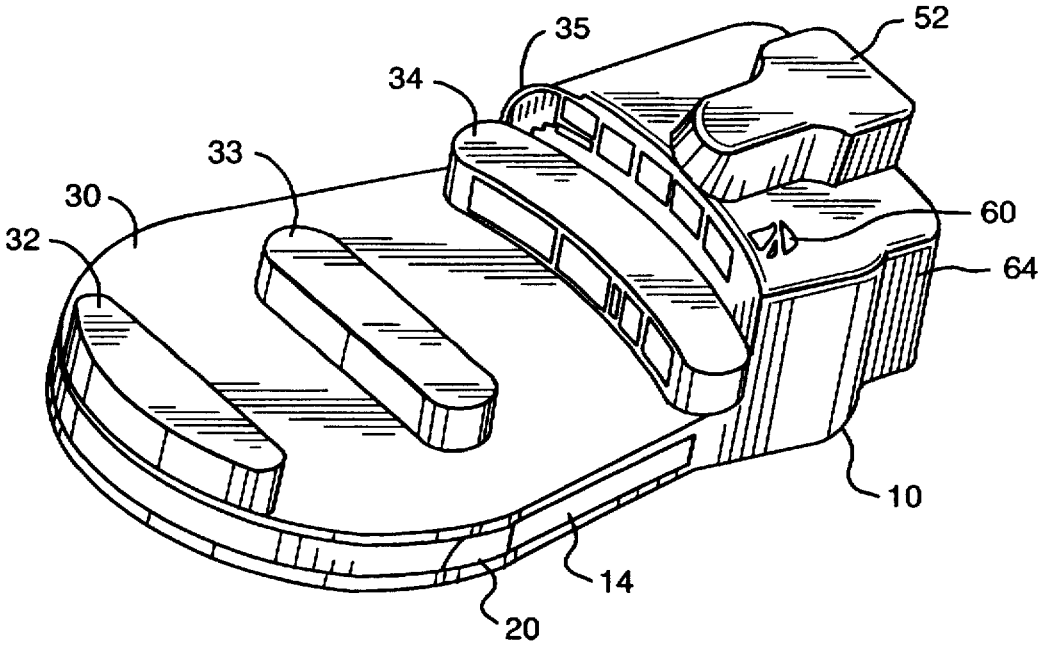
FIG. 4 is a perspective view of the preferred embodiment of the invention from a left rear direction for a right handed golfer, or a left front direction for a left handed golfer.
Figure 5:
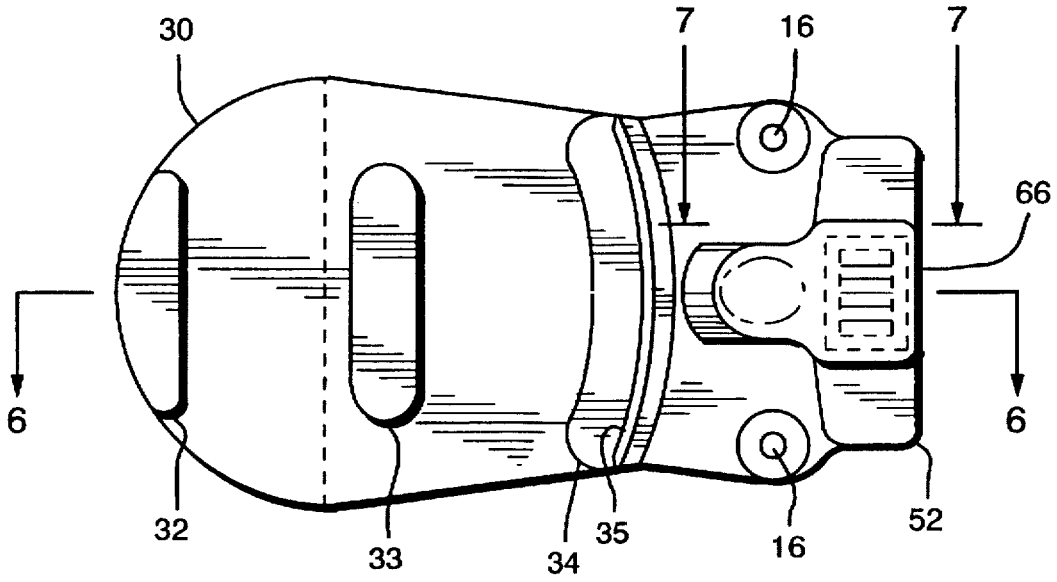
FIG. 5 is a top view of the embodiment of FIG. 4.
Figure 6:
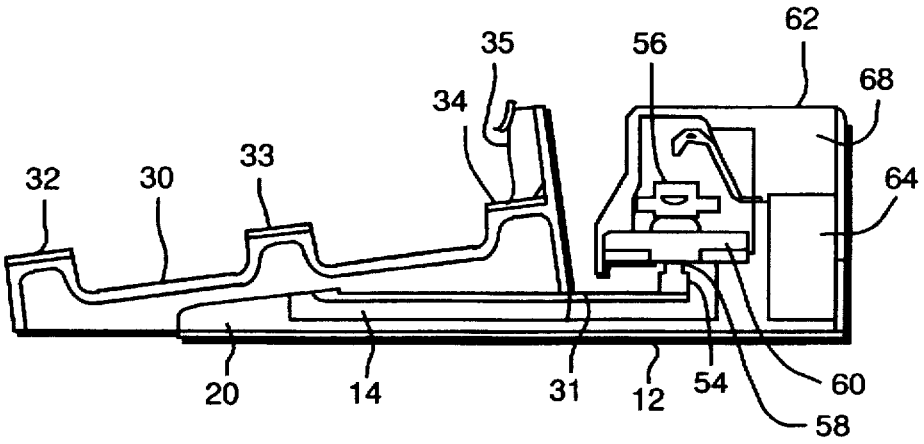
FIG. 6 is an AA section view of FIG. 5.
Figure 7:
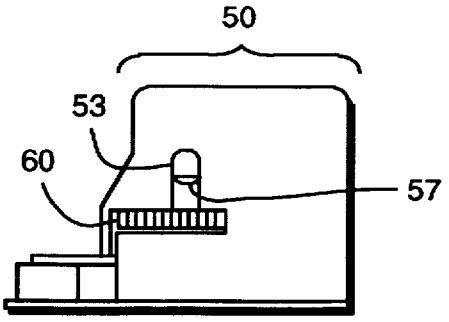
FIG. 7 is a BB section view of FIG. 5.

The preferred embodiment is illustrated in FIGS. 4–7. FIG. 4 shows a left rear perspective for a right-handed golfer. The major structural components are molded plastic. Base plate 10 is configured with fulcrum 20 at one edge, and nonskid rubber pad 12 bonded to the bottom. Foam pad 14 is positioned immediately adjacent to fulcrum 20 and is bonded to base plate 10. Top plate 30 is formed with toepads 32, 33 and 34, and shoulder 35 protruding upwardly from the outboard edge of toepad 34. Top plate 30 is positioned with it's centerline approximately aligned over fulcrum 20, and is bonded to foam pad 14 such that it may be rotated on fulcrum 20 to compress the foam pad.

Buzzer module 50 is located outboard of top plate 30 on base plate 10. Module cover 52 of buzzer module 50 is attachable to base plate 10 via tapered pins in the base plate and tapered holes in the cover. Module cover 52 houses battery box 64, buzzer 68, and buzzer switch assembly 56, and incorporates a battery box door 66.

Switch assembly 56 has a normally closed electrical contact which closes a circuit between battery box 64 and buzzer 68. Threaded barrel 58 of switch assembly 56 is vertically oriented and rotatingly engaged in threaded adjustment wheel 60. The perimeter of adjustment wheel 60 extends outward of cover 52 through the horizontal portion of inverted T slot 53. Switch plunger 54 extends downward from switch assembly 56. Anti-rotation tab 57 is affixed to switch assembly 56 and is engaged with the vertical section of inverted T slot 53 to constrain rotation while allowing vertical adjustment. Adjustment wheel 60 is rotatable to cause vertical adjustment to switch assembly 56 and it's plunger 54. Actuator tongue 31 is affixed to and protrudes from the underside of top plate 30, passing underneath the adjacent edge of cover 52, extending to beneath switch plunger 54.

The preferred embodiment device performs as follows: Batteries are installed in battery box 64 via battery box door 66. The device is positioned on the ground in the appropriate place for the immediate user relative to the tee. The device may be pegged to the ground with a pair of tees, through golf tee interface holes 14. The user, with driver in hand, positions himself or herself with the ball area of the aft foot resting on top plate 30 and with his or her weight properly balanced as between fore and aft feet, and balanced as to weight distribution across the sole of the aft foot. If the device isn't buzzing, adjustment wheel 60 is turned clockwise, raising plunger 54 away from tongue 31 until the buzzer starts. The wheel is then adjusted counterclockwise until with the user in balance, lowering the switch assembly and plunger 54 against tongue 31 until the buzzing is silenced.

To use the training aid of FIGS. 4, 5, 6 and 7, a golfer positions the training aid as required for the aft or back foot, in relationship to the position of the ball. When addressing the ball, the golfer places his right foot (or left foot in the case of left handed golfers) firmly on top plate 30 with the outer edge of the shoe aligned with and adjacent to shoulder 35.

If, during the swing, the user maintains balance, tongue 31 will remain in contact with plunger 54, holding the switch open and keeping the buzzer in the off condition, or silent. Conversely if, during the swing, the user shifts his or her weight to the aft foot or to the shoulder edge of top plate 30, tongue 31 will be tipped down and disengage with plunger 54, allowing the buzzer to sound, providing audible feedback to the user of any weight shift to the aft foot or to the outboard edge of the aft foot.

It will be noted that the top plate 30 and toepads 32, 33, and 34 are configured to accept a cleated golf shoe, and that the device is symmetrical and may be used by either left or right handed golfers.

The objects and advantages of the invention may be further realized and attained by means of the instrumentalities and combinations particularly pointed out in claims filed elsewhere and referenced hereto. Accordingly, the drawings and description are to be regarded as illustrative in nature, and not as restrictive.

We claim:

1. A training aid for indicating an unbalanced stance, comprising means for sensing weight at the outer edge of a shoe of the user, means for calibrating said means for sensing weight to a null value for a balanced stance, and means for indicating a condition of greater weight than said null value.

2. The training aid of claim 1, said means for sensing weight comprising a base plate, an elastic element, a top plate with a reference edge, said top plate configured to accept the placement of a said shoe thereon with one edge of said shoe immediately adjacent to said reference edge, said top plate having a non-rigid spatial relationship to said base plate, said elastic element interposed between and contacting said top plate and said base plate, and means for detecting changes in said spatial relationship between said top plate and said base plate caused by increasing weight at said outer edge of said shoe.

3. The training aid of claim 2, said means for detecting said change in said spatial relationship comprising a proximity switch and actuator combination interconnected between said top plate and said base plate, said proximity switch being operable by said actuator upon change to said spatial relationship.

4. The training aid of claim 3, said means for calibrating to a said null value for said balanced stance comprising means for adjusting relative distance between said actuator and said proximity switch to where a change in said spatial relationship caused by a slight increase in weight at said outer edge of said shoe on said top plate will operate said switch.

5. The training aid of claim 4, said means for indicating said condition of greater weight comprising an electrical power source and audible signal generator connectable by operation of said proximity switch.

6. The training aid of claim 1, said means for sensing weight comprising a base plate incorporating a fulcrum, a foam pad, a top plate with a reference edge, said top plate configured to accept the placement of a said shoe thereon with one edge of said shoe immediately adjacent to said reference edge, said top plate having a non-rigid spatial relationship to said base plate such that said fulcrum is beneath and offset to the instep side of the centerline of said top plate, said foam pad being interposed between said top plate in the region of said reference edge and said base plate, and means for detecting compression of said foam pad.

7. The training aid of claim 6, for a golfer, said stance being a golfer's stance for swinging a golf club, said shoe being the aft shoe of said golfer in said stance, said top plate being adapted with toe pads to accommodate cleated golf shoes, said reference edge being an upwardly protruding shoulder on said top plate against which the outer edge of said shoe may be placed.

8. The training aid of claim 6, said means for detecting said compression comprising a rigid tongue member extending from said top plate laterally away from said fulcrum to the plunger of a proximity switch affixed to said base plate, said proximity switch being operable by said tongue member upon said compression of said foam pad by said top plate.

9. The training aid of claim 8, said means for calibrating to a said null value for said balanced stance comprising means for adjusting relative distance between said tongue member and said proximity switch to where a change in said compression of said foam pad caused by a slight increase in weight over that present in said balanced stance at said outer edge of said shoe on said top plate will operate said proximity switch.

10. The training aid of claim 9, said means for adjusting relative distance between said tongue member and said proximity switch comprising an adjustment wheel with a threaded bore, said adjustment wheel constrained from vertical motion relative to said base plate and rotatingly engaged with a threaded barrel on said proximity switch, said proximity switch being constrained from rotation relative to said base plate, whereby manual rotation of said adjustment wheel causes vertical adjustment to said proximity switch.

11. The training aid of claim 10, said means for indicating said condition of greater weight comprising an electrical power source and audible signal generator connectable by operation of said proximity switch.

12. The training aid of claim 11, said electrical source comprising a battery box with at least one battery attached to said base plate, said audible signal generator comprising a buzzer.

13. A training aid for indicating an unbalanced stance, comprising means for sensing weight at the outer edge of a shoe of the user, means for indicating amount of said weight, and means for calibrating said means for indicating to a null value for a balanced stance.

14. A method for indicating an unbalanced stance, comprising the steps of sensing weight at the outer edge of a shoe of the user, calibrating the sensed said weight to a null value for a balanced stance, and indicating a condition of greater weight than said null value.

* * * * *